United States Patent [19]

Reylek et al.

[11] Patent Number: 5,049,085

[45] Date of Patent: Sep. 17, 1991

[54] ANISOTROPICALLY CONDUCTIVE POLYMERIC MATRIX

[75] Inventors: Robert S. Reylek, Shoreview; James G. Berg, North St. Paul, both of Minn.

[73] Assignee: Minnesota Mining and Manufacturing Company, St. Paul, Minn.

[21] Appl. No.: 652,213

[22] Filed: Feb. 5, 1991

Related U.S. Application Data

[63] Continuation of Ser. No. 456,602, Dec. 22, 1989, abandoned, which is a continuation of Ser. No. 342,713, Apr. 21, 1989, abandoned, which is a continuation of Ser. No. 110,093, Oct. 14, 1987, abandoned, which is a continuation of Ser. No. 796,330, Nov. 6, 1986, abandoned.

[51] Int. Cl.[5] ..... H01R 9/09

[52] U.S. Cl. ..... 439/91; 439/591

[58] Field of Search ..... 339/17 M, 17 LM, 17 F, 339/59 M, 61 M, DIG. 3; 29/830, 840, 849, 852, 883, 884; 174/117 A, 84 R, 88 R, 94 R; 439/65, 66, 74, 91, 591

[56] References Cited

U.S. PATENT DOCUMENTS

| | | | |
|---|---|---|---|
| 3,524,921 | 8/1970 | Wolf . | |
| 3,557,446 | 1/1971 | Charschan | 29/625 |
| 3,605,063 | 9/1971 | Stewart . | |
| 3,954,317 | 5/1976 | Gilissen et al. . | |
| 4,003,621 | 1/1977 | Lamp | 439/91 |
| 4,008,300 | 2/1977 | Ponn | 264/104 |
| 4,170,677 | 10/1979 | Hutcheson | 29/830 |
| 4,548,862 | 10/1985 | Hartman . | |
| 4,591,220 | 5/1985 | Impey | 29/830 |

FOREIGN PATENT DOCUMENTS

| | | |
|---|---|---|
| 0147856 | 12/1984 | European Pat. Off. . |
| 2475302 | 1/1981 | France . |
| 1477780 | 6/1977 | United Kingdom . |

OTHER PUBLICATIONS

Scotchlink Connector Tape, Electro-Products Div/3M, St. Paul, MN, 3-1984.

*Primary Examiner*—Neil Abrams

*Attorney, Agent, or Firm*—Gary L. Griswold; Walter N. Kirn; Darla P. Neaveill

[57] ABSTRACT

An anisotropically conductive polymeric matrix comprising a polymeric layer having conductive members extending substantially through the thickness thereof, said conductive members comprising a coating of a conductive material, and a process for making same.

26 Claims, 6 Drawing Sheets

ANISOTROPICALLY CONDUCTIVE POLYMERIC MATRIX

CROSS-REFERENCES TO RELATED APPLICATIONS

This application is a continuation of application Ser. No. 07/456,602, filed Dec. 22, 1989 (now abandoned) which was a continuation of application Ser. No. 07,342,713, filed Apr. 21, 1989 (now abandoned) which was a continuation of application Ser. No. 07/110,093, filed Oct. 14, 1987 (now abandoned) which in turn was a continuation of application Ser. No. 06/796,330, filed Nov. 6, 1986 (now abandoned).

TECHNICAL FIELD

This invention is directed to an anisotropically conductive polymeric matrix for providing electrical interconnection between electronic components having a fine pitch, i.e., wherein the contact or terminal pads on the electrical component are extremely closely spaced. More specifically, the anisotropically conductive polymeric matrix of the invention has uniformly spaced electrical conductors therethrough, on extremely close spacings, which are electrically isolated from each other, the conductors being formed from a coating of conductive material contained within the polymeric matrix, and a process for making same.

BACKGROUND ART

Small electronic components, such as integrated circuit chips or devices, terminal pads of printed circuit boards, liquid crystal displays, etc. typically have bonding locations for electrical interconnection to circuitry external to the particular device. In many instances, the spacings required between each electrical interconnection are extremely close, i.e., on the order of 0.1 mm for chips, and electrical isolation must be maintained between adjacent connections.

One technique for electrical bonding such components is through the utilization of an array of contact points spread over the face of the device (also known as "flip chip" devices). Such contact points in such devices are commonly electrically connected to external circuitry by aligning the array of bonding locations with corresponding bonding locations on the external circuitry and forming a metallurgical bond between the two sets of bonding locations by, for example, reflow soldering. In such instances, the arrays of bonding locations often comprise metallized bumps or protrusions extending above the surface of the device.

Such techniques typically have serious drawbacks. First, the coefficients of thermal expansion between the electronic components to be connected can vary greatly, which may cause physical stress on the metallurgical bond between the bonding locations during the thermal cycling encountered during testing and use of the assembled parts. Second, it is normally necessary to remove heat generated during electrical functioning of the device. One of the most effective means of such removal is by conducting the heat from the device to an adjacent substrate, which can best be accomplished by maximizing the contact between the semiconductor or electronic device and, for example, its ceramic package. In the case of flip chip devices, however, the contact area to the surrounding package is often limited to the area of the metallurgical bonds, which can comprise as small as five percent of the total area of the device, thus severely impairing removal of heat from the device to the adjacent substrate.

A second technique is based on the use of conductive particles to provide the necessary contact. Such particles are contained within a polymeric, typically adhesive, system such that the particle surfaces extend from one face of the adhesive to the other. When electrical connection is to be made, pressure is applied to the contact area to compress or deform the particles to maximize the electrical contact.

This technique suffers from a severe drawback when contact spacings are on a fine pitch. This is because such systems have random spacing between conductors. Voids or clusters of particles are common, thus leading to short circuiting with fine pitch spacings of contacts.

In contrast thereto,, the present system affords extremely uniform spacing of conductors for ease of use with fine pitch contact spacings without short circuiting. In addition, the extreme uniformity of the height and deformability of our conductive passages, and thus the reduced bonding forces necessary to provide stable contact areas is a distinct and heretofore unavailable advantage over these prior techniques.

SUMMARY OF THE INVENTION

The present invention provides an anisotropically conductive polymeric matrix comprising a polymeric layer or film, preferentially adhesive in nature, having a plurality of conductive members therethrough uniformly spaced such that each is isolated from one another. The edge surfaces of the conductive members are defined by coatings of a conductive material to thus allow conductance of an electric current through the polymeric layer, but not along its major surfaces, unless a pattern of such conductance is desired.

The isolation of the electrical conductors allows for electrical conductivity in the direction through the layer of adhesive but not in the direction along the major surfaces of the layer of adhesive, i.e., anisotropically. The use of a coating of a conductive material as the electrical conductor rather than a particulate conductor allows for the use of greatly reduced pressures in the electrical activation of the adhesive due to uniformity of the heights of the conductors and their conformability, and the uniform spacing reduces the possibility of short circuiting.

When the polymeric matrix described above is placed in tape form on a suitable backing having a plurality or parallel, separated, electrically conductive stripes which allows for conductivity along the plane of the tape, the resulting tape is also useful for the electrical interconnection of electronic devices physically spaced apart from each other.

This invention also relates to a preferred method of preparing the anisotropically conductive polymeric matrix of this invention. The method comprises the steps of:

a) depositing a coating of conductive material upon at least a portion of a plurality of discrete projections contained on a low surface energy substrate;

b) depositing a layer of nonconductive polymeric material onto the substrate, such that the plurality of discrete projections define a plurality of isolated conductive members through the polymeric layer;

c) removing the substrate from the polymeric material wherein the conductive coating remains with the polymer; and d) removing the conductive material from the surface of the polymer between the discrete isolated conductive members.

In this fashion, a uniform array of conductive members oriented through the polymeric matrix can be provided. In essence, the polymeric matrix thus exhibits anisotropic conductivity, i.e., conductivity through the layer of polymer. Because the coating of the conductive material defining the conductive member can be made extremely thin, the conformability thereof can approach that of the polymer itself. Thus, because compression of the solid particulate matter is not necessary, bonding pressures necessary for the electrical activation of the resin can be substantially less than prior art systems. Furthermore, the uniform spacing allows use with electronic component connection having contact points on an extremely close pitch.

DETAILED DESCRIPTION OF THE INVENTION

To form the polymeric matrix of the invention, a substrate having low surface energy characteristics, i.e., a release surface, is first prepared. Examples of such materials are low surface energy polymeric films such as polyethylene and teflon. This substrate must have sufficient structural integrity to maintain a plurality of uniform discrete projections therefrom which will serve to form the conductive members through the polymer layer when the polymer is applied thereto.

Figure 1A:
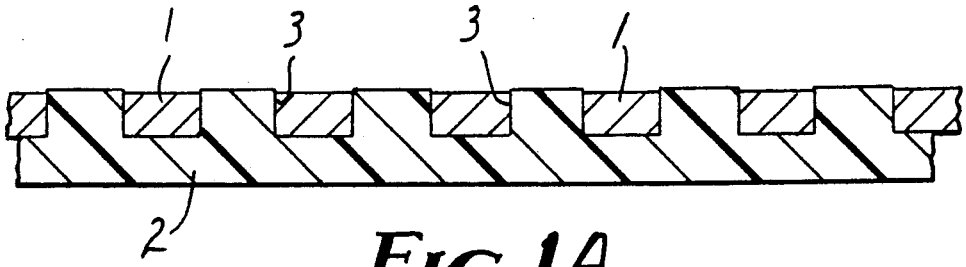
FIGS. 1A–1G illustrate a process for producing the anisotropically conductive polymeric material of the invention.
Figure 1B:
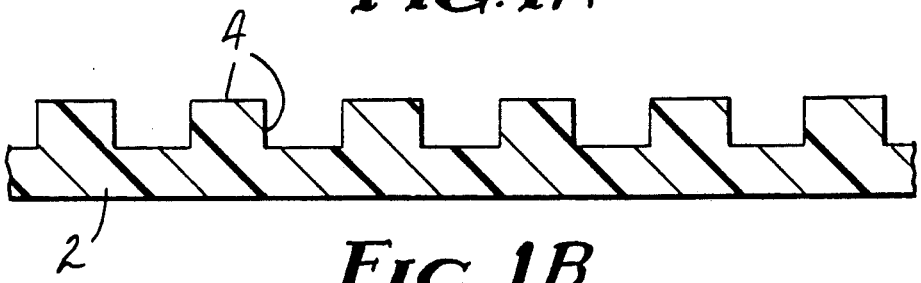
Figure 1C:
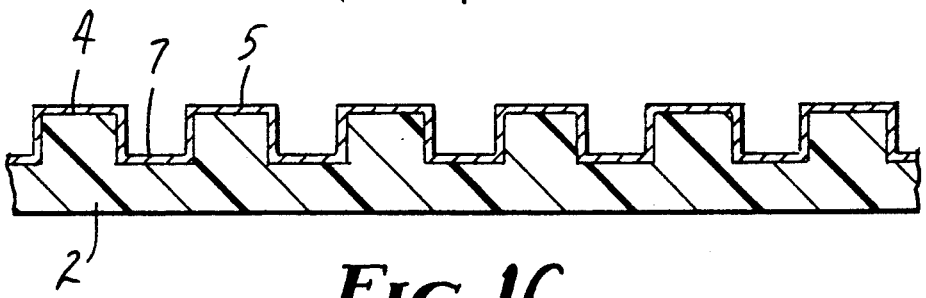
Figure 1D:
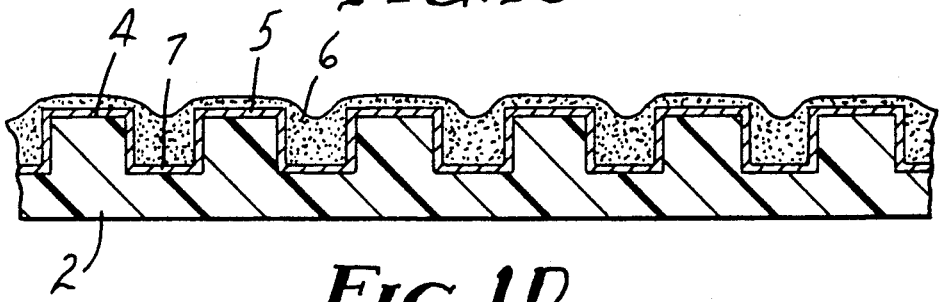
Figure 1E:
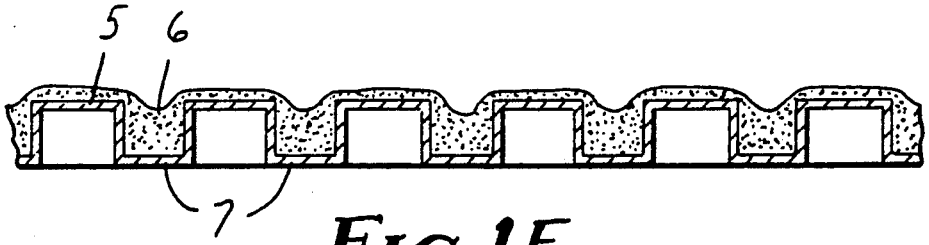
Figure 1F:
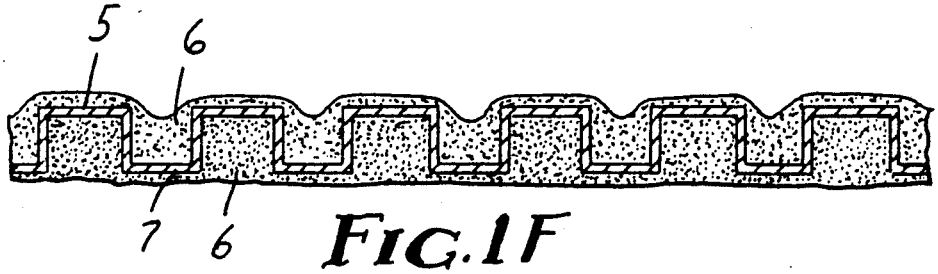

The discrete projections may be formed by a variety of suitable methods. One preferred method is to bring the substrate into contact with, for example, a stainless steel screen through which holes corresponding to a desired size and uniform spacing have been provided, typically by chemical machining. This is illustrated in FIG. 1, wherein at (A) stainless steel screen 1 is brought into physical contact under moderate heat and pressure with film substrate 2, thus causing film 2 to in essence extrude through the openings 3 in the screen to form a plurality of discrete projections 4 in a uniform array, as shown in FIG. 1(B).

The most preferred method for forming the requisite substrate is to first form a pattern in a rigid plastic sheet material, such as an acrylic, with a device such as a diamond turning machine. Such machines have extremely fine tolerances such that a variety of pattern arrays can be produced at an extremely fine pitch. The acrylic sheet can then be used to make a metal pattern, which will take the place of stainless steel screen 1 of FIG. 1(A). Alternatively, a metal plate can be diamond turned to provide a requisite pattern.

Once the desired pattern of discrete projections 4 have been formed on substrate 2, the surface containing the projections is deposited with a conductive coating 5 as illustrated in (C). Such a coating is preferably comprised of metals such as aluminum, copper, nickel, silver, gold, tin and the like. Preferably a "seed" coat is first applied via vapor or electroless deposition. The seed coat is simply a conductive surface that an electroplated metal can be built up on. Conventional electroplating can then be undertaken over the seed coat. The total of the seed coat and electroplate thickness can typically be from about 100 Å to 0.005". As the thickness increases, the conductor wall becomes stiffer and less deformable, decreasing the contact efficiency.

Following attainment of metallic coating 5, the polymeric matrix 6 is applied to the coated surface, as shown in (D), followed by simple removal of substrate 2 from the composite, as by peeling, for example, wherein conductive coating 5 is retained by polymer 6. (FIG. 1(E)).

Preferably, polymer is then also applied to the backside of the composite, so that the conductive material 5 is completely encased in polymer 6. (FIG. 1(F)).

Because the metallic coatings in the valleys 7 between the conductors 5 is normally not desired in the final product, same can be removed by any of several techniques.

A preferred method is simply to grind the polymer and conductive coating away from the unwanted areas after application of the polymer. The conductive tops can also be similarly removed. (FIG. 1(G)).

Figure 1G:
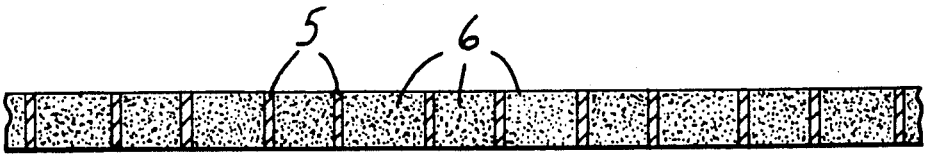
Figure 2:
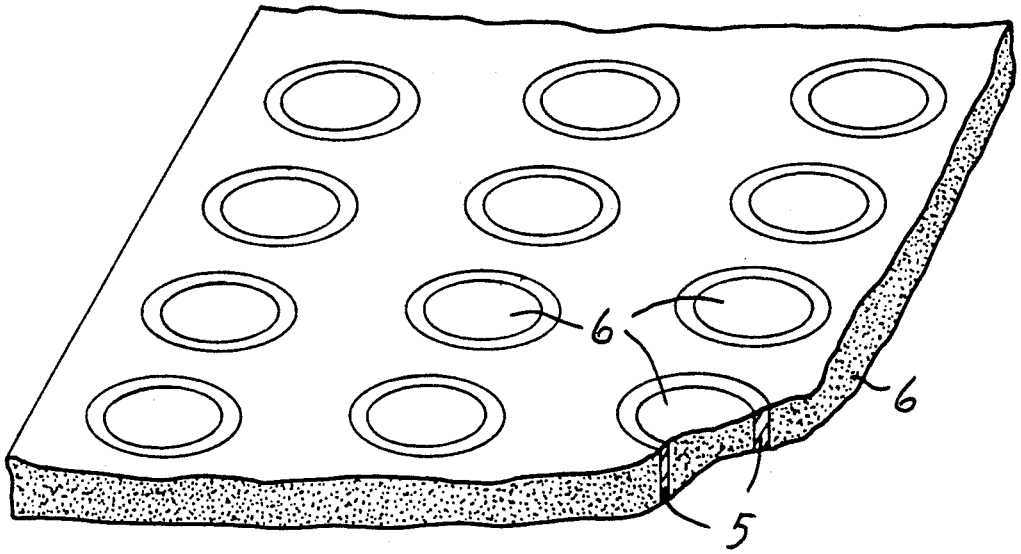
FIG. 2 is an isometric view of the completed matrix from the process depicted in FIG. 1.

FIG. 2 is a perspective view of the completed anisotropically conductive matrix, the end view thereof being shown in FIG. 1(G). In this particular instance, the conductive members 5, as illustrated, are cylinders extending through polymer layer 6.

Figure 4D:
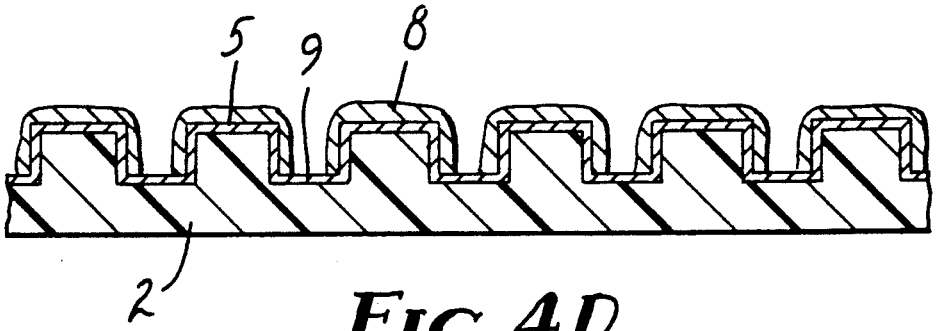
FIGS. 4D–4G illustrate a second process technique utilizing a resist composition in the formation of the conductive members.
Figure 4E:
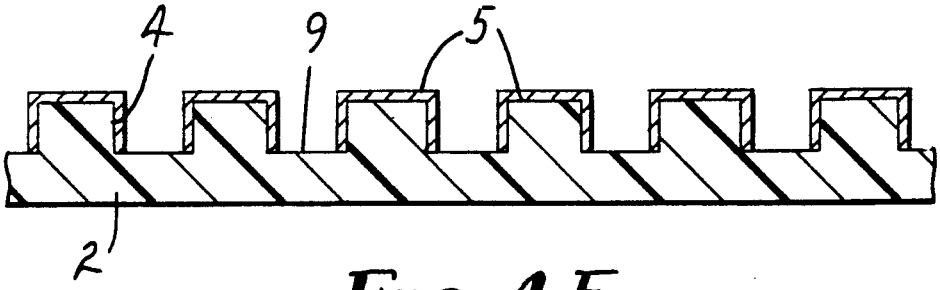
Figure 4F:
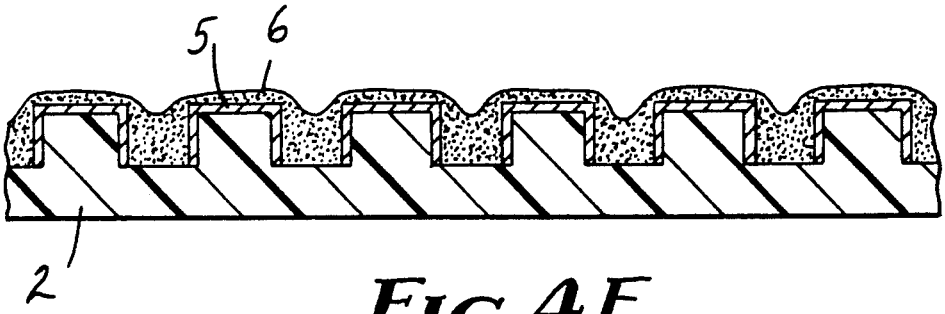
Figure 4G:
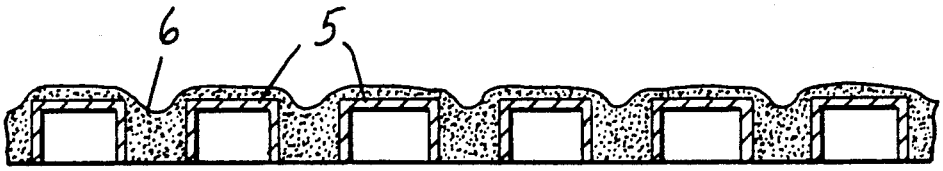

As an alternative to the process of FIG. 1, with steps (A)–(C) being the same, as illustrated in FIG. 4, the undesired conductive coating can be conventionally etched away by first applying a resist coating 8 to each of the conductors, (FIG. 4(D)), followed by etching all areas not covered by the resist, such as at 9, followed by removal of the resist if this material is not compatible with the polymer utilized. (FIG. 4(E)). Polymer 6 is then applied to the substrate surface such that the plurality of discrete projections 4 form a plurality of conductive members 5 through polymer 6. (FIG. 4(F)). When polymer layer 6 is pulled away from substrate 2, the conductive material coating the discrete projections will coat the edge surfaces of the passages through the polymer layer because the adhesion between the conductive material and the surfaces of the discrete projections is lower than that between the conductive material and the polymer. (FIG. 4(G)). The composite can then be completed as per the process of FIG. 1.

Yet still another alternative involves the application of the polymer matrix to the substrate from which the conductive material 7 between the discrete projections 4 has not been removed. When the polymer layer is pulled away from the substrate, an adhesive tape (not illustrated) can be applied to that face of the polymer layer bearing the metallic coating. After uniformly adhering the tape, same can simply be removed, removing with it the undesired conductive material 7 and leaving a plurality of conductive members through the polymer.

If selective electrical interconnections are desired between conductive members, the removal of undesired conductive coating can be undertaken in a patterned fashion to allow desired connections to remain.

As a second method of preparing an anisotropically conductive polymer matrix not requiring the use of a preformed substrate as discussed above, a polymer coating can be applied to a flat release film, followed by the formation of openings through both by using, for example, laser drilling. In this instance, a conductive coating can be applied to the inside of the openings in conventional fashion, such that conductive material does not electrically connect the openings. The removal of the low release liner can then be effected, leaving the polymer with a uniform array of conductive members therein.

The size and spacing of the plurality of discrete projections 4 on substrate 2 is important, because it will determine the size and spacing of the conductors 5 through the polymeric layer 6. Uniformity and spacing of the discrete projections 4 is therefore an important variable as they will affect the electrical performance of the polymer layer. The key consideration is that the discrete projections 4, and thereby the conductive members, are spaced no more than a maximum distance apart to avoid open circuits, and are no closer than the minimum distance to avoid short circuits. Also, the plurality of discrete projections 4 from substrate 2 should typically form a repeating pattern, though not necessarily with equal spacings throughout. Any deviation from the repeating pattern should be no greater than about ten percent, but in no case should there be occasional short circuits between the conductive members which extend through the polymer layer.

The center to center spacings of the discrete projections in the substrate will depend upon the particular use of the anisotropically conductive polymer matrix, a typically useful range being from about 0.01 millimeter to about 10 millimeters. Values close to the upper limit of this range are especially useful in static control applications of the unidirectionally conductive matrix, where the polymer is typically an elastomeric composition.

Figure 8:
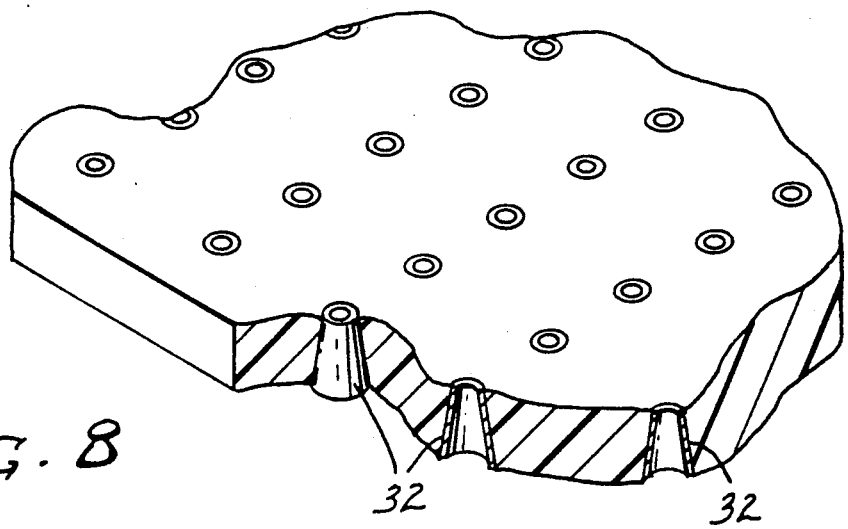
FIGS. 8, 9 and 10 are isomeric views of polymeric layers, each of which is an anisotropically conductive polymeric matrix of the invention.
Figure 9:
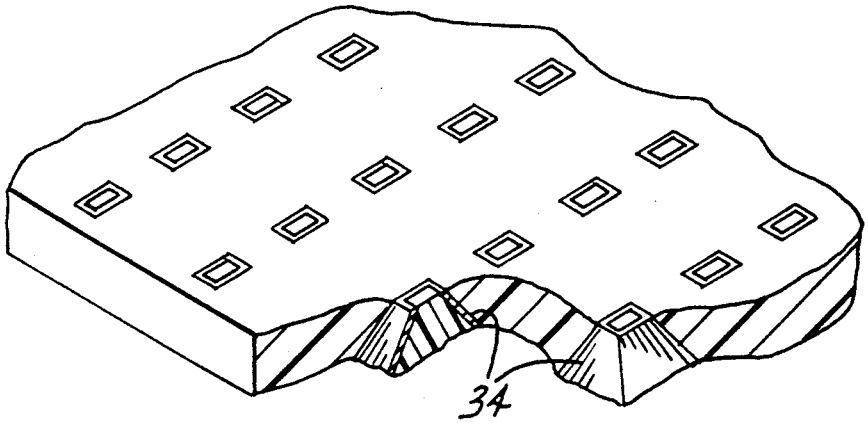
Figure 10:
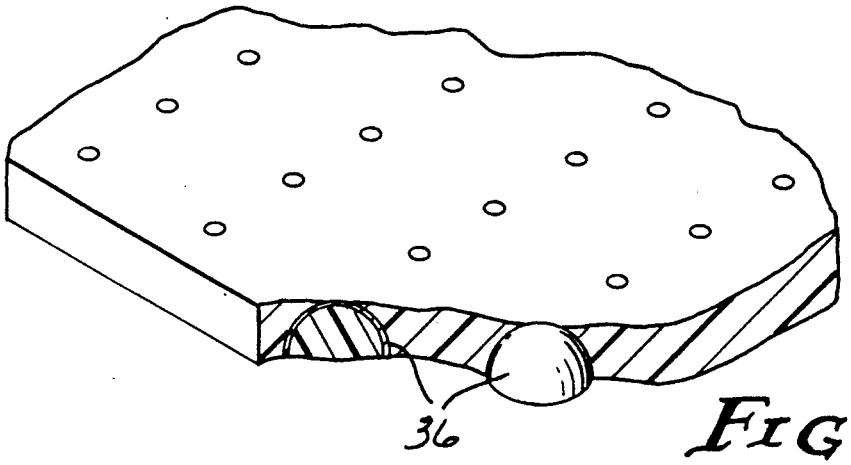

The conductive members are preferably "tubular" in design. By tubular is meant an object which has an open central portion and closes upon itself. Thus, tubular includes a variety of geometries, based on wall shapes, such as cylinders, cones 32 of FIG. 8, pyramids 34 of FIG. 9, hemispheres 36 of FIG. 10, squares, or cubes, and other and polyhedrons, and parallelepiped surfaces, closed or open on one or both ends, and filled or unfilled with polymer. The discrete projections, and as a result thereof the conductive members through the resin, preferably have corners, such as in a pyramid or square shape, to provide greater structural strength and integrity to the conductive members through the polymer to make and maintain adequate electrical contact.

The aspect ratio, i.e., the ratio of the height of the conductor to the largest width or diameter thereof has been found to be a useful parameter. Generally, it is preferred that this ratio be from 1 to 10 to 10 to 1. As this ratio decreases, the conductor becomes increasingly stiffer, i.e., less conformable, and as such provides reduced electrical contact. Increasing ratios increase flexibility of the conductors such that they may become too flexible to maintain good electrical contact because of the reduction in structural integrity thereof.

In addition, the term the "conductive aspect ratio" also has some importance relative to the invention. This is the ratio of the height of the conductor to the thickness of the conductive layer forming the conductor sidewalls. Generally this ratio can be on the order to 2 to 1 to 2000 to 1. Decreasing ratios exhibit the same problems noted above, while increasing ratios provide decreased conductance because the sidewalls thereof are too thin and the conductor is too flexible.

It should be pointed out that while tubular conductors are preferred as conductive members, the latter term also includes conductors formed from only a portion of the tubes. In other words, a conductive coating can be applied to only a portion of each of the discrete projections 4 on substrate 2, or the coating can be removed from portions of the discrete projections during processing. Accordingly, the term conductive member is meant to include any conductor formed by the application of a conductive coating through the thickness of the polymeric matrix.

The mechanical characteristics of each of the conductors can be controlled by the design, i.e., shape or geometry of the conductors, the wall thickness thereof, the conductor coating material, and, to some degree, the specific polymeric matrix chosen. For example, it has been found that good electrical connection characteristics, equivalent to those achieved utilizing solid silver particles in conventional adhesive systems where the particle thickness is essentially the same as the adhesive, can be achieved using conductors having a coating, i.e., wall, thickness of approximately 30,000 Å of metallic silver. Furthermore, the mechanical properties of such conductors are very different from the solid silver particulate adhesives in that they are very compliant and do not limit the flow of the polymer substantially during bonding. The impact of such a configuration is displayed by considering that a polymeric matrix previously made with, for example, solid silver particles, required a bonding force of 12 pounds when bonding a 50×50 mil integrated circuit. Contrastingly, the novel polymeric matrix having conductive thin walled members provides similar ellectrical connection characteristics with a bonding force of only 100 grams. Furthermore, it has also been discovered that the bonding time required when utilizing polymeric matrices as discussed herein can be reduced from several seconds to less than one second.

Figure 3:
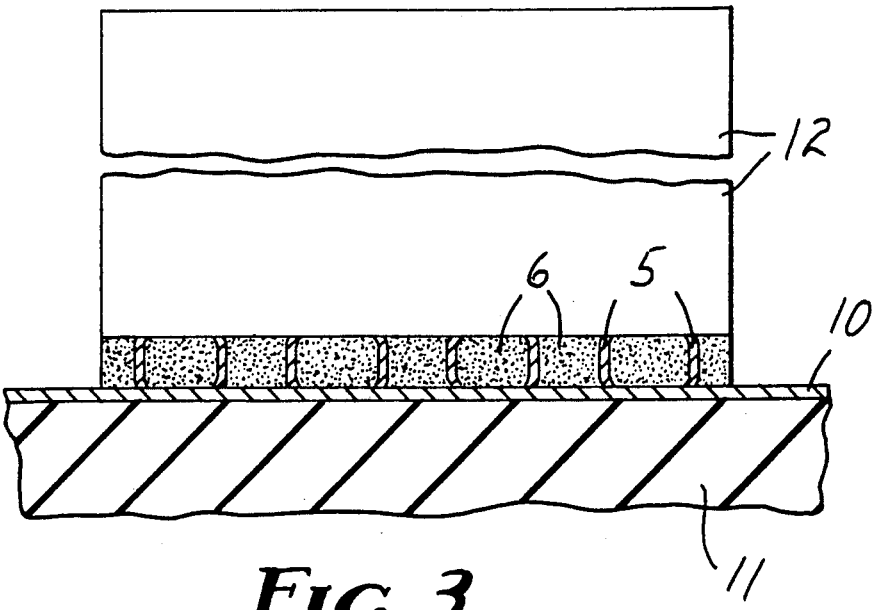
FIG. 3 is an end view of the anisotropically conductive polymer matrix making electrical contact between, e.g., a die and a printed circuit board.

FIG. 3 illustrates the use of the polymeric matrix illustrated in FIG. 2. Die 12 is attached by polymeric matrix 6 containing conductive members 5 to substrate 11 containing electrically conductive layer 10 thereon, such that electrical contact is made therebetween.

Figure 5:
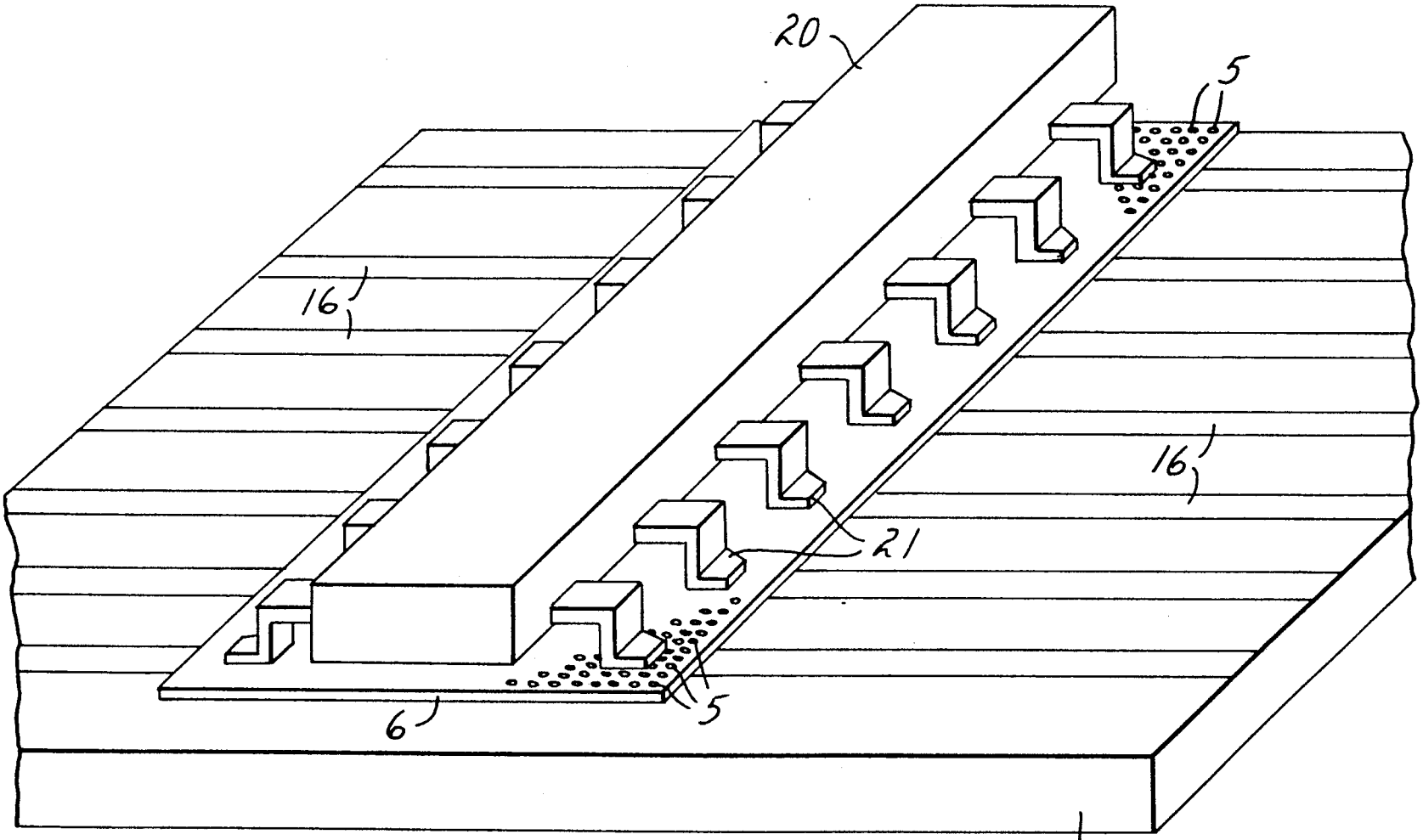
FIG. 5 is a perspective view illustrating use of the matrix of FIG. 2 bonding and allowing electrical contact between an electronic component and a printed circuit board.

FIG. 5 illustrates a perspective view of a second use of the polymeric matrix of FIG. 2. Printed circuit board 15 having electrical contacts 16 thereon is bonded by polymeric matrix 6 having conductive members 5 therein to an electronic component 20 having legs 21 with contact points at the feet of legs 21 for electrical connection. As is illustrated, the polymeric matrix 6 in this instance actually bonds electronic component 20 to printed circuit board 15 as well as providing electrical contact therebetween.

Figure 6:
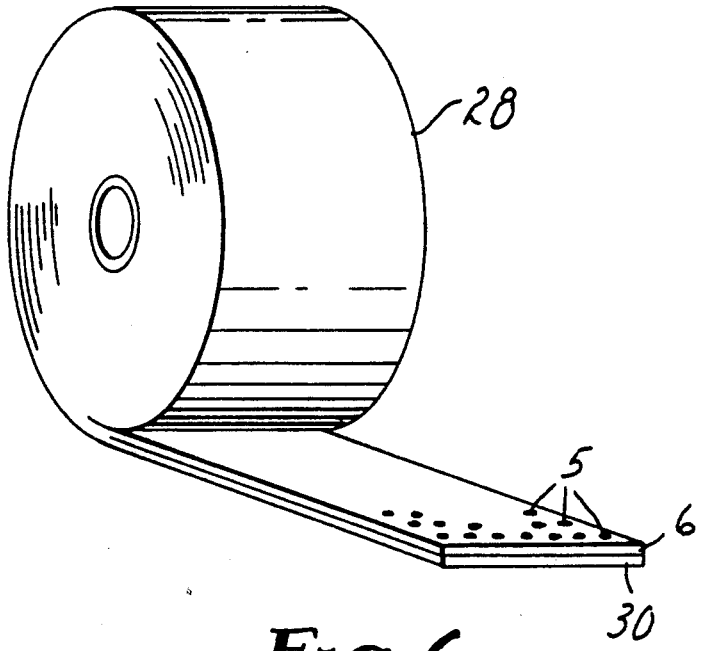
FIG. 6 is a prospective view illustrating a roll of the conductive polymeric matrix on a backing.
Figure 7:
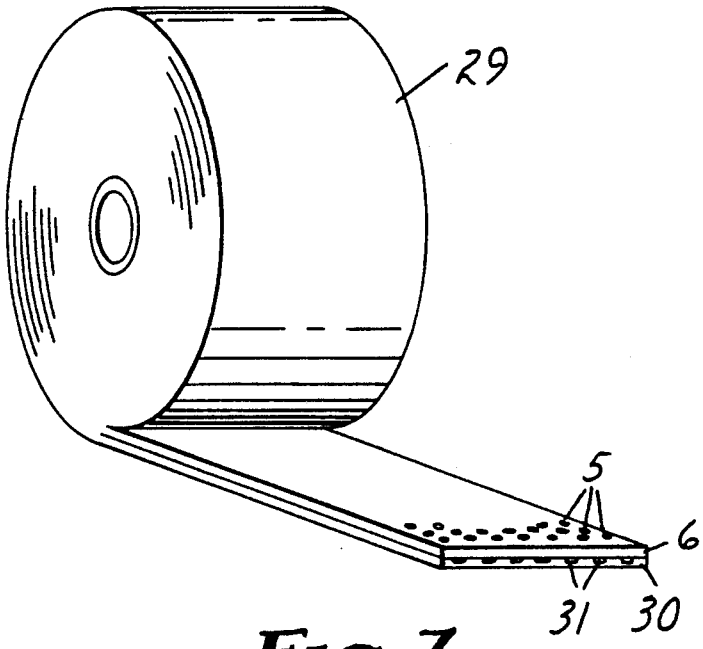
FIG. 7 is a prospective view illustrating a roll of the conductive polymeric matrix on a backing which contains a plurality of conductive stripes extending the length of the backing.

In addition to the foregoing, it may be desirable to utilize the polymeric matrix of the invention on a flat, flexible, electrically insulating sheet or backing 30. The matrix on a backing 30 may then be provided in the form of a roll 28 as shown in FIG. 6. Such typically comprises a polymeric film, such as polyethylene terephthalate or polyimide. The backing 30 in this instance should be flexible so as to allow conformance during bonding operations. To allow for electrical connection to isolated electronic equipment, the backing 30 (as shown in FIG. 7) can contain electrically conductive stripes 31 thereon which will underlie at least a portion of the polymer matrix and extend along the length of the tape. The matrix on a backing 30 containing conductive stripes 31 may then be provided in the form of a roll 29 as shown in FIG. 7. Such stripes typically comprise a layer of metal, such as silver, gold, etc., vapor deposited onto the planar backing. Such layers do not typically diminish the flexibility of the backing. Other examples of useful conductive layers include a metal foil (which may constitute the whole backing or may be adhered to the backing with, for example, an adhesive), a layer of metal sputtered onto the backing, or a layer formed from a conductive coating composition or ink, typically comprising a coating vehicle and conductors such as metal or carbon particles.

The choice of polymer to form the polymer matrix will, of course, depend upon the susceptibility of the polymer to the formation and maintenance of the conductors therethrough. In other words, the chosen polymer is one that allows the formation of isolated conductive members therethrough, the walls thereof being a coating of a conductive material, and which will maintain the isolation of the conductive members. Accordingly, the polymer may be of a thermoplastic or thermosettable polymeric material with sufficient integrity for handling during assembly, but with some flow during the activation process to provide a uniform bond and allow contact elements to make electrical contact with the conductive walls of the conductive members. If the polymer is elastomeric, the matrix can be used for static electricity control, as well as for making electrical contact to components.

The polymer is preferably an adhesive, and one which is preferably heat-activated such that an adhesive bond will be formed during a heating operation. During the heating operation the adhesive material wets out the substrate to which adhesion is to be made. Subsequently, either by cooling or reaction of the ingredients, the adhesive hardens so that at room temperature the conductors through the adhesive layer are held in place with respect to an adherend. At this point the adhesive material is either nontacky or poorly tacky.

A preferred adhesive material, known as a "hot-tackifying adhesive", is described in a copending application of Robert H. Stow, filed as application Ser. No. 445,864, on Dec. 6, 1982 (a continuation-in-part of which is now U.S. Pat. No. 4,880,683), and incorporated herein by reference. As described in that application, the adhesive material is nontacky or poorly tacky at 20° C., but becomes pressure-sensitive and aggressively tacky when heated. Good bonds are immediately formed at a tackifying temperature without any need for crosslinking or other chemical reactions. The adhesive material comprises an acrylic polymer or mixture of acrylic polymers of at least one alkyl acrylate and/or methacrylate ester monomer (here called "acrylic ester monomer"), and differs from prior art adhesive materials in that:

1) acrylic ester monomer provides at least 50 mol percent of the one or more acrylic polymers of the adhesive layer,

2) said one or more acrylic polymers have a $T_g$ (glass transition temperature) or a weight-averaged $T_g$ of $-10°$ to 80° C.,

3) a layer of the adhesive material has a) a Probe Tack Value of less than 75 grams of force (gf) at 20° C., b) Probe Tack Values of at least 75 gf over a range of at least 50° C., which values remain substantially constant after 30 days at 40° C., and c) a Shear Value of at least 25 minutes at 65° C., and

4) up to 50 mol percent of the one or more acrylic polymers can be provided by copolymerizable monomer having a polar group, such as acrylic acid, methacrylic acid, itaconic acid, maleic acid or anhydride, the amides of said acids, acrylonitrile, methacrylonitrile, and N-vinyl-2-pyrrolidone.

The Probe Tack Value is determined as described in ASTM D-2979 except in the following respects:

1. To provide Probe Tack Values at various test temperatures, the probe and the annular weight are heated to the test temperature, except that the annular weight is never heated above 220° C.

2. The probe end is an annulus having inner and outer diameters of 3.83 and 5.10 mm.

3. The annular weight is 19.8 grams

4. Ten-second dwell.

The Shear Value is determined by heating a bright annealed stainless steel panel in an oven for 15 minutes at 115° C. above the weight averaged $T_g$ of the adhesive polymer. With the steel panel horizontal, part of a tape 1.27 cm in width is adhered to the steel panel using a 2.04-kg hand roller conforming to Federal Standard 147, giving 2 passes in each direction. The length of tape adhering to the panel is trimmed to exactly 1.27 cm in length and this assembly is left at the bonding temperature for 15 minutes longer. The plate is transferred to an oven having a shear stand which allows a 2° backward tilt of the panel at its top (shear weight will force tape toward panel slightly). After 15 minutes at 65° C., a one-kilogram weight is hung from the free end of the tape. The time after which the weight falls is the 65° C. Shear Value.

The one or more acrylic polymers may be a homopolymer of an acrylic ester monomer which provides a $T_g$ within the range of $-10°$ to 80° C., e.g., methyl acrylate, or a copolymer of acrylic ester monomer and copolymerizable polar monomer having a $T_g$ within that range. Useful acrylic ester monomers which homopolymerize to a $T_g$ of at least $-10°$ include methyl acrylate, methyl methacrylate, ethyl methacrylate, propyl methacrylates, butyl methacrylates, bornyl acrylates, bornyl methacrylates, 2-phenoxyethyl acrylate, 2-phenoxyethyl methacrylate, the mono- and di- methyl and ethyl esters of itaconic acid, and the mono- and dimethyl and ethyl esters of maleic acid. Useful acrylic ester monomers which provide reduced $T_g$ include ethyl, butyl, and octyl acrylates, and n-amyl, hexyl and octyl methacrylates. A copolymer of 43 mol percent of methyl methacrylate, 53 mol percent of methyl acrylate and 4 mol percent of acrylamide had a $T_g$ of about 50° C. A copolymer of 73 mol percent of methyl methacrylate, 19 mol percent of methyl acrylate, 4 mol percent of ethyl acrylate, and 4 mol percent of acrylamide had a $T_g$ of about 79° C.

The described hot tackifying adhesive material becomes pressure-sensitive and aggressively tacky when heated to a temperature of about 40° C. or above, and preferably 75° C. or above. When later subjected to temperatures at or even above the bonding temperature, adequate bonding strength is retained.

Other copolymerizable monomers may also be employed in small amounts without detracting from the value of the acrylic copolymer for the purposes taught in the application. Among such copolymerizable monomers are styrene, vinyl acetate and vinyl chloride, each of which can be used in amounts up to about 5 mol percent of the total monomers.

As is taught in U.S. Pat. No. 4,569,879 of James Groves, and incorporated herein by reference, bonds exhibiting the best durability during prolonged exposure to high humidity (e.g., 95% RH) at elevated temperatures (e.g., 80° C.) are obtained with hot tackifying acrylic adhesives in which the acrylic polymer has an interacted functionally reactive organosilane coupling agent in an amount of at least 0.2 part per 100 parts by weight of total monomer. Best results are attained at about 0.5 to 4 percent.

The organosilane may be interpolymerized with the acrylic ester monomer, with or without other copolymerizable monomers, or it may be reacted with functional groups on the backbone of an acrylic polymer. Either process results in what is hereinafter called an "acrylic-silane interpolymer".

The organosilane has the general formula $R_{(4-n)}SiX_n$, where X is a hydrolyzable group such as ethoxy, methoxy, or 2-methoxy-ethoxy; R is a monovalent organic radical of from 1 to 12 carbon atoms which contains a functional organic group such as mercapto, epoxy, acrylyl, methacrylyl, or amino; and n is an integer of from 1 to 3.

As is known in the art, the organosilane can cause solutions of polymers to gel, so that it may be desirable to employ an alcohol or other known stabilizers. When the organosilane is to be copolymerized with the other monomer, a stabilizer should be selected that does not interfere with the polymerization. Methanol is especially useful and is preferably employed in amounts from about twice to about four times the amount of the organosilane.

Other heat-activated adhesive materials that can be used are hot-melt adhesives, which are typically thermoplastic materials that soften to a flowable state and then cool to form an adhesive bond, and reactive compositions, such as polyesters, polyamides, polyimides and epoxy-based adhesives. Sheet material in which the adhesive is pressure-sensitive at room temperature may also benefit from the present invention, i.e., by the use of electrical conductors in a size relationship as taught herein with the layer of pressure-sensitive adhesive on a flexible backing, especially under circumstances in which the bonded electrical connection to be made with the sheet material does not experience high ambient temperatures and stresses.

Adhesive sheet material of the invention especially when an elongated tape to be wound upon itself in roll form, preferably includes a low-adhesion backsize on the non-adhesive side, or a release liner disposed over the insulating layer. Also, primers may be applied to a polymeric or metallic backing to promote adhesion to an adhesive or insulating layer carried on the backing.

Sheet material of the invention are generally applied by aligning an end of the tape over the desired substrate to which connection is to be made, pressing the sheet material against the substrate, and at the same time heating the sheet material Transfer adhesive sheet materials of the invention may be placed between desired adherends and a bonded electrical connection made by applying heat and pressure. In such transfer adhesive sheet materials, conductive members may be contained in an adhesive material which forms a support web for the conductors, and an insulating layer may be disposed on one or both sides of the conductor-containing web with the conductive members protruding from both sides of the web. Alternatively, the material in which the conductors are contained can be a non-adhesive polymeric film, and adhesion is provided by the insulating layer. Similarly, the layer may be non-adhesive, e.g., because of reaction to a durable, firm state.

In addition to the foregoing, the conductive members may be contained in an elastomeric matrix, and can be used to provide static electricity control, e.g., as a mat. In this instance, the conductive coating connecting adjacent conductors need not be removed, because it is desired to dissipate electrical charge, not create electrical interconnections. Furthermore, with an elastomeric matrix, electrical connections can be made by use of a clamp or other means to compress the elastomer The invention will be further illustrated by the following non-limiting examples, wherein all parts are by weight unless otherwise specified.

EXAMPLE 1

A sheet of standard Polyethylene 0.010 inch thick was placed onto a metal mold having an array of discreet cylindrical holes therein, 0.004 diameter inch×0.002 inch high on 0.008 inch centers. The combination was preheated to 300° F. (149° C.), then pressure was applied whereupon the polyethylene was forced into the openings cooled under pressure to 200° F. (93° C.) After removing the mold from the press, the embossed polyethylene was peeled from the mold and on the surface of the polyethylene was a series of cylindrical protrusions.

At this point approximately 500Å of silver was chemically deposited over the entire surface of the polyethylene having the array of protrusions on it.

Then, via conventional electroplating, approximately 0.0002 inch of silver was plated over the conductive coating previously applied to the protrusion-containing polyethylene surface.

An adhesive mixture of 47.5 parts methyl methacrylate, 47.5 parts of methyl acrylate, 5 parts of acrylamide and 0.2 part of VAZO, a catalyst, along with 200 parts of ethyl acetate was held under a nitrogen atmosphere at 60° C. for 30 hours. The adhesive was then allowed to cool.

This adhesive was then applied over the conductive side of the polyethylene via a standard knife coater. The sample was allowed to dry for 10 minutes at room temperature and 10 minutes at 167° F. (75° C.) The dry adhesive thickness between the protrusions was approximately 1.5 mils.

The adhesive/silver combination was then simply peeled from the polyethylene.

At this time a coating of the same adhesive was applied to the conductive surface that was against the polyethylene. It is desirable that this application of adhesive fill the holes in the sample that were formed by the protrusions on the polyethylene.

This layer of adhesive was dried in the same manner as the adhesive on the other side of the conductive layer.

The sample at this stage has a conductive layer with an array of tubular conductors and an adhesive layer on both sides.

It is at this stage that the conductive surface between the tubular conductors, and the conductive tops of the conductors were removed via a polishing process.

The polishing equipment used was Buehler Ltd. Metallurgical Apparatus using an 8 inch diameter 3M Brand 15 micron Diamond grinding disc available from the Minnesota Mining and Manufacturing Company.

A water flush was used during polishing to remove debris. A 2 inch × 10 inch sample was held onto the disc by the weight of a hand held (2 inch wide by 1.5 inch diameter) rubber roller. As the grinding disc rotated at 500 rpm the sample was pulled out from under the roller in a direction opposite to the rotation of the disc.

This step was repeated until all of the unwanted conductive material was removed from between the tubular conductors in the adhesive. When the grinding step was completed on the first side of the sample, the sample was turned over and the grinding step repeated until the conductive portion corresponding to the tops of the tubular conductors was removed.

At the completion of the grinding operation, the sample was air dried until any moisture that was absorbed during the grinding step was removed.

The sample was then transferred to a 3 inch diameter by 0.020 inch thick aluminum-coated silicon wafer. This was done by placing the sample onto the wafer at 200° C. and then with moderate pressure rolling it down with a hand held rubber roller.

The wafer/adhesive combination was then cut or diced into 0.050 inch by 0.050 inch chips using conventional wafer dicing equipment. Then under heat (275° C.), pressure (100 grams) and time (0.2 second) the chips were bonded to a gold-coated ceramic test board. Other samples were prepared for aging tests. Prior to testing, conventional wire bonding was performed in order to complete contact between the chip and the test board contacts. Typical chip resistance was 0.1 ohms.

Aging tests were then run to monitor contact resistance at ambient temperature (23° C.), thermal cycle (four hour cycles of −40° C./+105° C.) and thermal aging (100° C.).

The resistance as bonded, including the chip resistance, was 1.8 ohms at 23° C. and after 1000 hours at 23° C. was 2.57 ohms. In the thermal cycle, initially the resistance was 0.5 ohms and after 1000 hours, 0.23 ohms. In the thermal aging test, the resistance was 1.7 ohms initially and 3.5 ohms after 1000 hours.

EXAMPLE 2

As taught in Example 1, a series of cylindrical protrusions was formed onto polyethylene and silver was deposited thereon.

At this stage the conductive material was removed from between the protrusions. This was done by first coating a resist over each protrusion. The resist used was an ink identified as No. 7410 manufactured by Marksem Corp.

A wet thickness of 1.5 mil of the ink was applied to a 3 inch diameter steel roll, with the sample being attached to another steel roll mounted directly above the inked roll and rotating in the opposite direction. As the rolls were rotated in opposite directions they were adjusted so the tops of the protrusions were penetrating the ink just enough so that each protrusion received a covering of ink but not the surface between the protrusions. After the ink was applied it was allowed to air dry.

The sample was then placed into a potassium cyanide stripping solution to etch away the conductive material left unprotected between the protrusions. The etching solution used was identified as "ARC-9035 Silver Stripper" manufactured by American Chemical & Refining Company, Inc.

After the etching process was completed the ink was removed in a bath of methyl ethyl ketone.

At this point in the sample preparation the polyethylene thus had a metallic silver coating on each protrusion.

The adhesive of Example 1 was then applied to the side of the sample having the conductive protrusions thereon. This was done via a knife coater to provide a dry film thickness between conductors of 1.5 mil.

The adhesive was dried and then removed from the polyethylene, taking with it the conductive parts that were formed on the polyethylene protrusions, thus forming the tubular conductors therein.

After removing the sample from the polyethylene, it was placed onto a 3 inch diameter by 0.020 inch thick aluminum-coated silicon wafer. This was done by placing the sample onto the wafer at 200° C. and then with moderate pressure rolling it down with a hand held rubber roller.

The wafer/adhesive combination was then cut or diced into 0.050 inch by 0.050 inch chips using conventional wafer dicing equipment.

Then under heat (275° C.), pressure (100 grams) and time (0.2 second) the chips were bonded to a gold coated ceramic test board. Samples were tested for shear. The test conditions consisted of an Instron X-head speed of 0.2 inch. Typical results were values of 3000 psi on the 0.050 inch by 0.050 inch chip. Other samples were prepared for aging tests. Prior to testing, conventional wire bonding was performed in order to complete contact between the chip and the test board contacts. Typical chip resistance was 0.1 ohm.

Aging tests were then run to monitor contact resistance at ambient temperature (23° C.), thermal cycle (−40° C./+105° C.) and thermal aging (100° C.).

Results as bonded, including the bare chip resistance, were 0.120 ohm at 23° C. and after 1000 hours at 23° C., 0.121 ohms. As bonded on thermal cycle, 0.24 ohms and after 1000 hours, 0.84 ohms, as bonded on thermal aging, 1.7 ohms and after 1000 hours, 9.2 ohms.

What is claimed is:

1. An anisotropically conductive polymeric matrix comprising a polymer layer having a plurality of electrically conductive members therethrough, spaced such that at least some of said members are electrically isolated from one another, said members being at least partically tubular and comprising a deformable coating of an electricallty conductive material formed in shapes which extend from one face of said layer substantially through the thickness thereof, such shapes resulting from the use of removable forming means, whereby electric current can be conducted through the thickness of said polymeric layer by said members.

2. The conductive polymeric matrix of claim 1 wherein said conductive material consists of a metal selected from the group consisting of aluminum, copper, nickel, silver, gold, tin, and palladium.

3. The conductive polymeric matrix of claim 2 wherein said metal has a thickness from about 100 angstroms to about 250,000 angstroms.

4. The conductive polymeric matrix of claim 1 wherein said polymeric layer comprises an elastomer.

5. The conductive polymeric matrix of claim 1 wherein said polymeric layer comprises an adhesive.

6. The conductive polymeric matrix of claim 5 wherein said adhesive is selected from a polyester and a polyamide adhesive having a glass transition temperature of from about −20° C. to about 200° C.

7. The conductive polymeric matrix of claim 5 wherein said adhesive comprises a curable epoxy resin.

8. The conductive polymeric matrix of claim 5 wherein said adhesive comprises a hot tackifying adhesive which exhibits a probe tack value of at least 75 grams of force at 40° C. or more.

9. The conductive polymeric matrix of claim 5 wherein said adhesive comprises one or more acrylic polymers and 1) an acrylic ester monomer provides at least 50 mol percent of the one or more acrylic polymers of said at least one adhesive layer;
2) said one or more acrylic polymers have a $T_g$ or a weight-averaged $T_g$ of −10° to 80° C., and
3) said at least one layer has
   a) a Probe Tack Value of less than 75 gf at 20° C.,
   b) Probe Tack Values of at least 75 gf over a range of at least 50° C., which values remain substantially constant after 30 days at 40° C., and
   c) a Shear Value of at least 25 minutes at 65° C., and said at least one layer adheres well to a clean substrate upon contact at any temperature within said 50° C. range.

10. The conductive polymeric matrix of claim 9 wherein said acrylic polymers are comprised of one or more acrylic copolymers of monomers, up to 50 mol % of which is at least one copolymerizable monomer selected from acrylic acid, methacrylic acid, itaconic, acid, maleic acid, maleic anhydride, amides of said acids, acrylonitrile, methacrylonitrile, and N-vinyl-2-pyrrolidone.

11. The conductive polymeric matrix of claim 9 wherein said acrylic ester monomer is selected from alkyl acrylates having 1–8 carbon atoms in their alkyl groups, alkyl methacrylates having 1–8 carbon atoms in their alkyl groups, bornyl acrylates, bornyl methacrylates, 2-phenoxyethyl acrylate, 2-phenoxymethyl acrylate, the mono- and di-methyl and ethyl esters of itaconic acid, and the mono- and di-methyl and ethyl esters of maleic acid.

12. The conductive polymer matrix of claim 9 in which at least one of styrene, vinyl acetate and vinyl chloride comprises up to 5 mol percent of the total monomers.

13. The conductive polymeric matrix of claim 1 wherein said conductive members have an aspect ratio of from about 1 to 10 to 10 to 1.

14. The conductive polymeric matrix of claim 1 wherein said conductive members having a conductive aspect ratio of from about 2 to 1 to 2000 to 1.

15. A transfer tape wound upon itself in roll form comprising the conductive polymeric matrix of claim 1 on a flexible release backing.

16. An electrical connector tape wound upon itself on roll form and comprising a flexible backing having, on a major face thereof;

a) a plurality of conductive stripes in laterally spaced relation and
b) the polymeric matrix of claim 1 covering said major face.

17. An electronic assembly comprising a first electronic component having a surface with a plurality of conductive areas and a second electronic component having a surface with a plurality of conductive areas wherein the two surfaces are adhered to one another by the polymeric matrix of claim 1 to thereby allow the conductance of an electric current from said first component to said second component, but not between said conductive areas of each individual component.

18. The conductive polymeric matrix of claim 1 wherein the electrically conductive members are uniformly spaced.

19. The conductive polymeric matrix of claim 1 wherein the electrically conductive members are fully tubular.

20. The conductive polymeric matrix of claim 1 wherein the electrically conductive members are of substantially uniform height in the thickness direction of the matrix.

21. The conductive polymeric matrix of claim 1 wherein said polymeric layer comprises pressure-sensitive adhesive.

22. The conductive polymeric matrix of claim 1 wherein said shapes are cones, pyramids, or hemispheres.

23. The conductive polymeric matrix of claim 19 wherein the edge surface of each of said tubular members defines at least one corner.

24. A conductive polymeric matrix comprising an electrically insulative polymeric layer having a plurality of electrically conductive members therethrough, said conductive members being spaced from each other, said members comprising a deformable coating of an electrically conductive material extending from one face of said layer substantially through the thickness thereof, said members being formed in shapes which result from the use of removable forming means.

25. The conductive polymeric matrix of claim 24 wherein substantially all of said electrically conductive members are electrically isolated from one another.

26. The conductive polymeric matrix of claim 24 wherein said shapes are cones, pyramids, or hemispheres.

* * * * *

UNITED STATES PATENT AND TRADEMARK OFFICE

CERTIFICATE OF CORRECTION

PATENT NO. : 5,049,085

DATED : 9/17/91

INVENTOR(S) : Robert S. Reylek, James G. Berg

It is certified that error appears in the above-identified patent and that said Letters Patent is hereby corrected as shown below:

Column 2, Line 49, "plurality or", should read -- plurality of --

Column 5, Line 57, "other and polyhedrons", delete "and" to read -- other polyhedrons --

Column 6, Line 48, "ellectrical", correct spelling -- electrical --

Column 7, Lines 3, 4, and 5, "backing 30. The matrix on a backing 30 may then be provided in the form of a roll 28 as shown in FIG. 6.", should read as follows according to Amendment submitted June 22, 1990 -- backing. As shown in FIG. 6, this permits a length of polymeric layer 6 to be wound upon itself in the form of a roll 28 while being supported by a backing 30.

Column 10, Line 3, "materialTransfer", insert period -- material. Transfer --

Column 10, Line 26, "elastomer", insert period -- elastomer. --

UNITED STATES PATENT AND TRADEMARK OFFICE

CERTIFICATE OF CORRECTION

PATENT NO. : 5,049,085

DATED : 9/17/91

INVENTOR(S) : Robert S. Reylek, James G. Berg

It is certified that error appears in the above-identified patent and that said Letters Patent is hereby corrected as shown below:

Column 10, Lines 38 and 39, "forced into the openings cooled under pressure to 200°F (93°C.)" insert missing text between "openings" and "cooled" as follows -- forced into the openings in the mold. The mold and embossed polyethylene was then cooled under pressure to 200°F (93°C.). --

Column 13, Line 43, "itaconic," delete the comma -- itaconic --

Signed and Sealed this

Thirteenth Day of April, 1993

*Attest:*

STEPHEN G. KUNIN

*Attesting Officer*

*Acting Commissioner of Patents and Trademarks*